US009604472B2

(12) United States Patent
Uchino et al.

(10) Patent No.: US 9,604,472 B2
(45) Date of Patent: Mar. 28, 2017

(54) IMAGE RECORDING APPARATUS

(71) Applicant: BROTHER KOGYO KABUSHIKI KAISHA, Nagoya-shi, Aichi-ken (JP)

(72) Inventors: Yuta Uchino, Nagoya (JP); Wataru Sugiyama, Nishio (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/923,507

(22) Filed: Oct. 27, 2015

(65) Prior Publication Data

US 2016/0107454 A1 Apr. 21, 2016

Related U.S. Application Data

(63) Continuation of application No. 14/073,791, filed on Nov. 6, 2013, now Pat. No. 9,211,738.

(30) Foreign Application Priority Data

Mar. 29, 2013 (JP) ..... 2013-073330

(51) Int. Cl.
*B65H 3/44* (2006.01)
*B41J 11/00* (2006.01)
(Continued)

(52) U.S. Cl.
CPC ..... *B41J 11/007* (2013.01); *B41J 11/0045* (2013.01); *B41J 13/103* (2013.01);
(Continued)

(58) Field of Classification Search
CPC .. B65H 2405/11172; B65H 2405/3312; B65H 2405/1134; B65H 2405/1136; B65H 2407/21
See application file for complete search history.

(56) References Cited

U.S. PATENT DOCUMENTS 5,478,162 A 12/1995 Nakayama et al.
5,624,107 A 4/1997 Deguchi et al.
(Continued)

FOREIGN PATENT DOCUMENTS

CN 1180971 A 5/1998
CN 1640799 A 7/2005
(Continued)

OTHER PUBLICATIONS

Notification of First Office Action issued in corresponding Chinese Patent Application No. 2013105454307, with full translation, mailed Sep. 28, 2015.
(Continued)

*Primary Examiner* — Howard Sanders
(74) *Attorney, Agent, or Firm* — Merchant & Gould P.C.

(57) ABSTRACT

An image recording apparatus includes: an apparatus casing in which a transport path for transporting a sheet is formed; a first sheet support unit having a first support surface configured to support the sheet; a feed unit configured to feed the sheet supported by the first support surface to the transport path; a second sheet support unit having a second support surface configured to support the sheet; a transport unit configured to transport the sheet from the first and second sheet support units via the transport path; and a recording unit configured to record an image on the sheet transported by the transport unit in the transport path. The first and second sheet support units are arranged on one side surface of the apparatus casing, and the first and second support surfaces are configured to incline with respect to a placement surface on which the apparatus casing is placed.

9 Claims, 9 Drawing Sheets

(51) Int. Cl.

| | |
|---|---|
| ***B41J 13/10*** | (2006.01) |
| ***B41J 29/02*** | (2006.01) |
| ***B65H 3/06*** | (2006.01) |
| ***B65H 3/56*** | (2006.01) |
| ***B65H 5/26*** | (2006.01) |

(52) U.S. Cl.

CPC ..... *B41J 13/106* (2013.01); *B41J 29/023* (2013.01); *B65H 3/0661* (2013.01); *B65H 3/0684* (2013.01); *B65H 3/56* (2013.01); *B65H 5/26* (2013.01); *B65H 2404/611* (2013.01); *B65H 2405/1132* (2013.01); *B65H 2405/1134* (2013.01); *B65H 2405/1136* (2013.01); *B65H 2405/11172* (2013.01); *B65H 2405/211* (2013.01); *B65H 2405/212* (2013.01); *B65H 2405/3312* (2013.01); *B65H 2407/21* (2013.01)

(56) References Cited

U.S. PATENT DOCUMENTS

| | | | | |
|---|---|---|---|---|
| 6,000,870 | A * | 12/1999 | Koga | B41J 11/50 271/145 |
| 7,184,182 | B1 | 2/2007 | Kuroda et al. | |
| 7,455,285 | B2 | 11/2008 | Goh et al. | |
| 2005/0073085 | A1 | 4/2005 | Fukada et al. | |
| 2010/0329763 | A1 | 12/2010 | Hattori | |

FOREIGN PATENT DOCUMENTS

| | | | |
|---|---|---|---|
| JP | 6-298382 | A | 10/1994 |
| JP | 9-2684 | A | 1/1997 |
| JP | 10-1240 | A | 1/1998 |
| JP | 10-17181 | A | 1/1998 |
| JP | 2004-224463 | A | 8/2004 |
| JP | 2007-088682 | A | 4/2007 |
| JP | 2011-7910 | A | 1/2011 |
| JP | 2012-001329 | A | 1/2012 |

OTHER PUBLICATIONS

Notice of Reasons for Rejection issued in related application Japanese Patent Application No. 2013-073330, including partial translation is attached, Jul. 14, 2015.

* cited by examiner

IMAGE RECORDING APPARATUS

CROSS REFERENCE TO RELATED APPLICATION

The present application is a continuation application of U.S. patent application Ser. No. 14/073,791, filed Nov. 6, 2013, which further claims priority from Japanese Patent Application No. 2013-073330, filed on Mar. 29, 2013, the disclosures of both of which are incorporated herein by reference in their entirety.

BACKGROUND OF THE INVENTION

Field of the Invention

The present invention relates to an image recording apparatus for recording an image on a sheet transported through a transport path.

Description of the Related Art

An image recording apparatus is known, wherein a transport path is formed at the inside of an apparatus casing, and an image is recorded on a sheet which is guided to and transported through the transport path. Such an image recording apparatus has, in some cases, a paper feed cassette for supporting a plurality of sheets. Further, an image recording apparatus is known, which has a manual feed tray for guiding a sheet to a transport path distinctly from a paper feed cassette.

SUMMARY OF THE INVENTION

However, a problem arises such that the image recording apparatus is large-sized, if the construction including, for example, the paper feed cassette and the manual feed tray, in which the sheets can be supported on a plurality of side surfaces of the casing, is adopted.

The present invention has been made taking the foregoing problem into consideration, an object of which is to provide a small-sized image recording apparatus which can support sheets.

According to an aspect of the present invention, there is provided an image recording apparatus including: an apparatus casing in which a transport path for transporting a sheet is formed; a first sheet support unit which has a first support surface configured to support the sheet; a feed unit configured to feed the sheet supported by the first support surface to the transport path; a second sheet support unit which has a second support surface configured to support the sheet; a transport unit configured to transport the sheet from the first sheet support unit and the second sheet support unit via the transport path; and a recording unit configured to record an image on the sheet which is transported by the transport unit in the transport path, wherein the first sheet support unit and the second sheet support unit are arranged on one side surface of the apparatus casing, and the first support surface and the second support surface are inclined with respect to a placement surface on which the apparatus casing is placed.

The maximum size or dimension of the apparatus is decreased, and the installation area of the apparatus is decreased, because the first sheet support unit and the second sheet support unit are arranged on one side surface side of the apparatus casing, and the first support surface and the second support surface are inclined.

According to the present invention, the small-sized image recording apparatus capable of supporting the sheets is realized.

DESCRIPTION OF THE PREFERRED EMBODIMENTS

Figure 1:
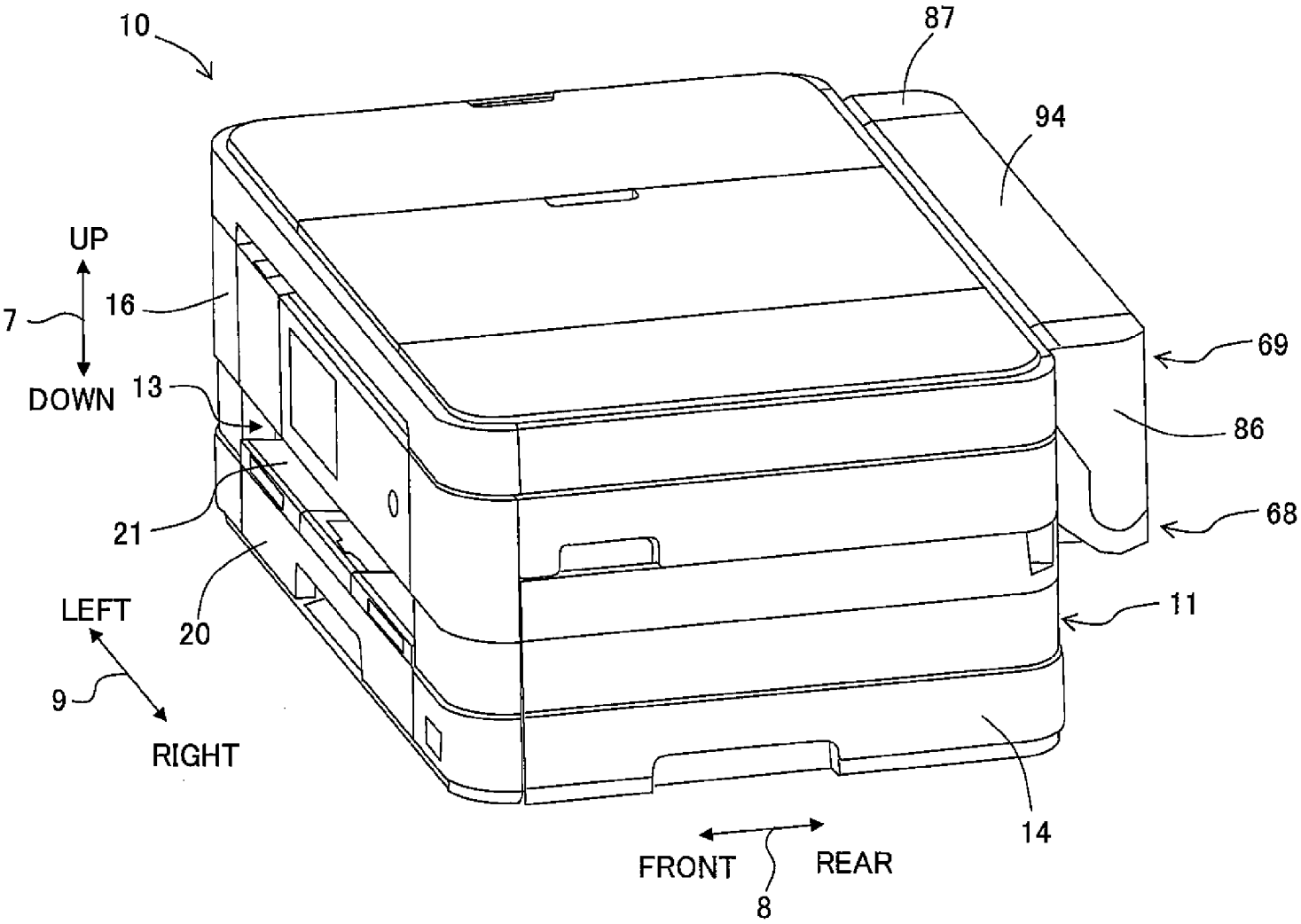
FIG. 1 shows a perspective view illustrating a multifunction machine in which a movable unit is in an upstanding state.

A multifunction machine 10 according to an embodiment of the present invention will be explained below. The embodiment explained below is merely an example of the present invention. It goes without saying that the embodiment can be appropriately changed within a range without changing the gist or essential characteristics of the present invention. Further, in the following explanation, the up-down direction 7 is defined based on a state (state shown in FIG. 1) in which a multifunction machine 10 (example of the image recording apparatus of the present invention) is installed usably, a front-rear direction 8 is defined assuming that a side on which an opening 13 is provided is a front side (front surface), and a left-right direction 9 is defined while viewing the multifunction machine 10 from the front side (front surface).

<Overall Arrangement of Multifunction Machine 10>

As shown in FIG. 1, the multifunction machine 10 is formed to have a substantially rectangular parallelepiped shape. The multifunction machine 10 is provided with a printer unit 11 for recording an image on a recording paper sheet or the like in accordance with the ink jet recording system. The multifunction machine 10 has various functions including, for example, the facsimile function and the print function. The printer unit 11 corresponds to the image recording apparatus.

The printer unit 11 has a casing 14 which is formed with an opening 13 disposed on the front surface. Further, a feed tray 20 and a discharge tray 21, on which the recording paper sheets of various sizes can be placed, can be inserted/ removed in the front-rear direction 8 with respect to the opening 13. The feed tray 20 corresponds to the third sheet support unit.

Figure 5:
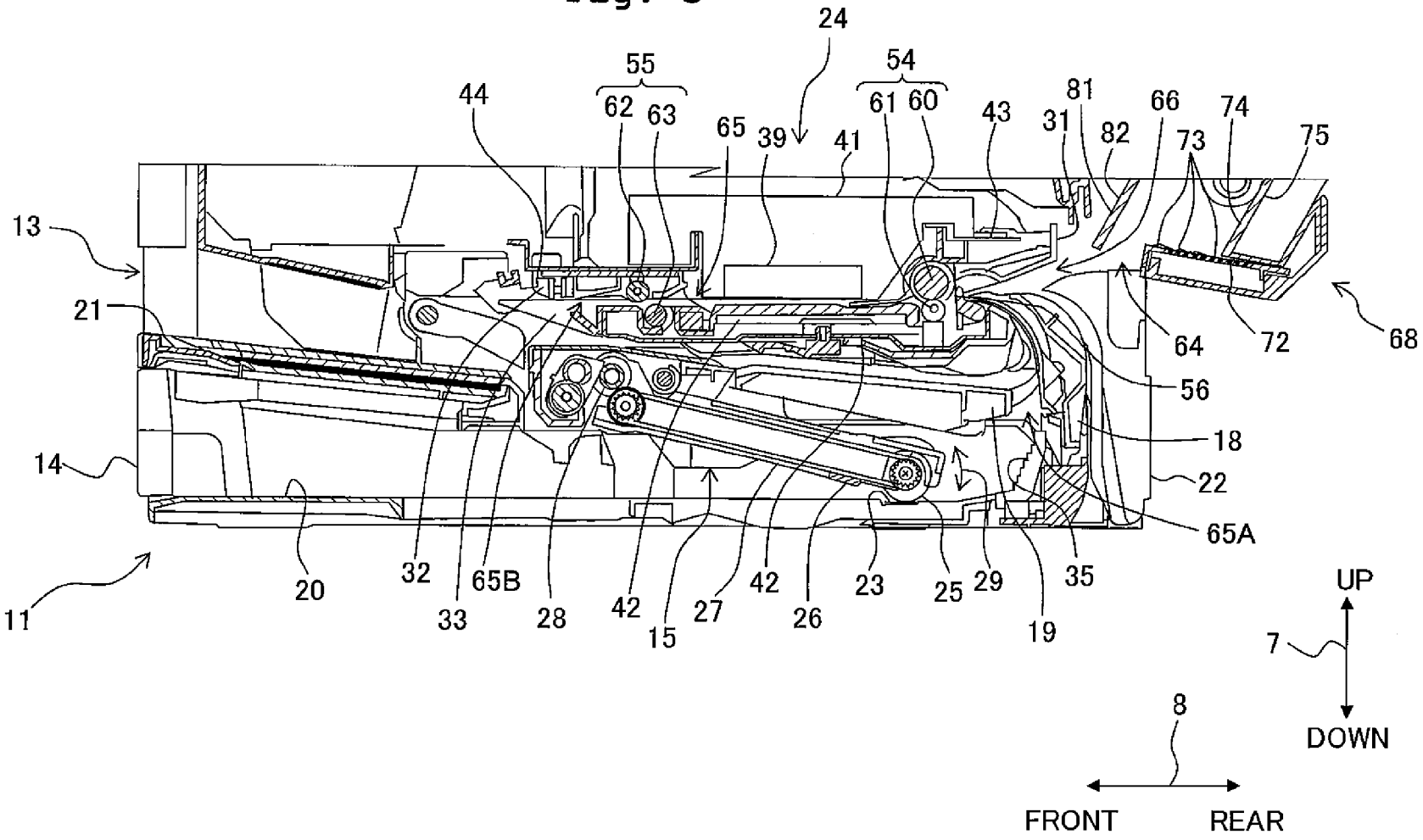
FIG. 5 shows a longitudinal sectional view illustrating the internal structure of a printer unit.

As shown in FIG. 5, the printer unit 11 is provided with, for example, a feed unit 15 for feeding the recording paper sheet from the feed tray 20, a recording unit 24 for recording an image on the recording paper sheet, a first transport roller pair 54, and a second transport roller pair 55.

As shown in FIG. 1, a scanner unit 12 is provided over or above the printer unit 11. The sizes of a casing 16 of the scanner unit 12 in the front-rear direction 8 and the left-right direction 9 are the same as those of the casing 14 of the printer unit 11. Therefore, the substantially rectangular parallelepiped-shaped contour (outer shape) of the multifunction machine 10 is formed by integrating the casing 14 of the printer unit 11 and the casing 16 of the scanner unit 12 into one unit while the scanner unit 12 is disposed at the upper position. The scanner unit 12 is a flat bed scanner. The structure of the flat bed scanner is known, and hence any detailed explanation thereof is omitted herein. The scanner unit 12 may be provided with an automatic document feeder (ADF) for picking up, one by one, and transporting a plurality of sheets of the manuscript or document for which the image reading is performed.

<Printer Unit 11>

The structure of the printer unit 11 will be explained in detail below.

<Feed Tray 20>

The feed tray 20 has such an outer shape that the lengths in the front-rear direction 8 and the left-right direction 9 are longer than the length in the up-down direction 7, and the feed tray 20 has a box-shaped form in which the upper portion is open or released. The discharge tray 21 is placed on the front side of the feed tray 20. For example, the recording paper sheets having various large and small sizes including, for example, the A4 size based on the Japanese Industrial Standards and the L size used for the photograph recording can be placed on the feed tray 20. The feed tray 20 is accommodated in the internal space communicated with the opening 13 of the casing 14. The feed tray 20 is movable back and forth in the front-rear direction 8 with respect to the casing 14 via the opening 13.

<Feed Unit 15>

As shown in FIG. 5, the feed unit 15 is provided with a feed roller 25, a feed arm 26, a driving transmission mechanism 27, and a separation pad 23. The feed unit 15 is provided above the feed tray 20 and below the recording unit 24. The feed roller 25 is rotatably supported by the forward end portion of the feed arm 26. The feed arm 26 is rotatable in the direction of the arrow 29 about the center of a shaft 28 provided at the proximal end portion. Accordingly, the feed roller 25 can abut against the bottom surface of the feed tray 20, and the feed roller 25 can be separated therefrom. The feed roller 25 can abut against the recording paper sheet placed on the feed tray 20. The separation pad 23 is provided at the position opposed to the feed roller 25 on the bottom surface of the feed tray 20. The separation pad 23 is a member which has the frictional coefficient larger than that of the bottom surface of the feed tray 20.

The driving force of a motor (not shown) is transmitted to the feed roller 25 by the aid of the driving transmission mechanism 27. The driving transmission mechanism 27 transmits the rotation transmitted to the shaft 28 to the shaft of the feed roller 25 by means of an endless belt. The feed roller 25 is rotated in such a state that the feed roller 25 is allowed to abut against the recording paper sheet disposed on the uppermost side of the recording paper sheets stacked on the bottom surface of the feed tray 20, and thus the recording paper sheet is fed to the transport path 65. When the recording paper sheet is fed to the transport path 65, the forward end of the recording paper sheet abuts against a separation member 35 which is provided on the back side in the front-rear direction 8 of the feed tray 20. Accordingly, the recording paper sheets, which are disposed on the lower side, are retained on the feed tray 20 without being dragged by the recording paper sheet which is disposed on the uppermost side. The recording paper sheet, which is disposed on the lowermost side, is not dragged owing to the frictional force generated with respect to the separation pad 23, when the recording paper sheet, which is disposed just thereover, is fed.

<Transport Path 65>

As shown in FIG. 5, the transport path 65, which is provided in the internal space of the casing 14, extends while being curved to make U-turn upwardly from the back side of the feed tray 20. Further, the transport path 65 is bent toward the front side from the back side of the printer unit 11 to extend substantially straight, and the transport path 65 arrives at the discharge tray 21. The transport path 65 is roughly classified into a curved passage 65*a* which makes U-turn and a straight passage 65B which is straight.

The curved passage 65A is formed by an outer guide member 18, an inner guide member 19, and a guide member 31 which are opposed to one another while being separated by the space through which the sheet can pass. The straight passage 65B is formed by a recording unit 24 and a platen 42 which are opposed to one another while being separated by the space through which the sheet can pass, a guide member 32 and a guide member 33.

The recording paper sheet in the feed tray 20, which is fed to the transport path 65 by the feed roller 25, is guided from the downward to the upward along the curved passage 65A, and thus the transport direction is inverted. After that, the recording paper sheet is transported from the backward to the frontward along the straight passage 65B without inverting the transport direction.

The outer guide member 18 is a member which constitutes the outer guide surface of the curved passage 65A. The inner guide member 19 is a member which constitutes the inner guide surface of the curved passage 65A. Each of the guide surfaces may be constructed by one surface, or each of the guide surfaces may be constructed by forward ends of a plurality of ribs. The outer guide member 18 corresponds to the first guide member.

The guide member 31 is arranged above the inner guide member 19 on the upstream side in the transport direction (on the back side) with respect to the first transport roller pair 54. The outer guide member 18 and the guide member 31 are also members for comparting a bypass route 66 described later on.

<Back Surface Cover 22>

Figure 8:
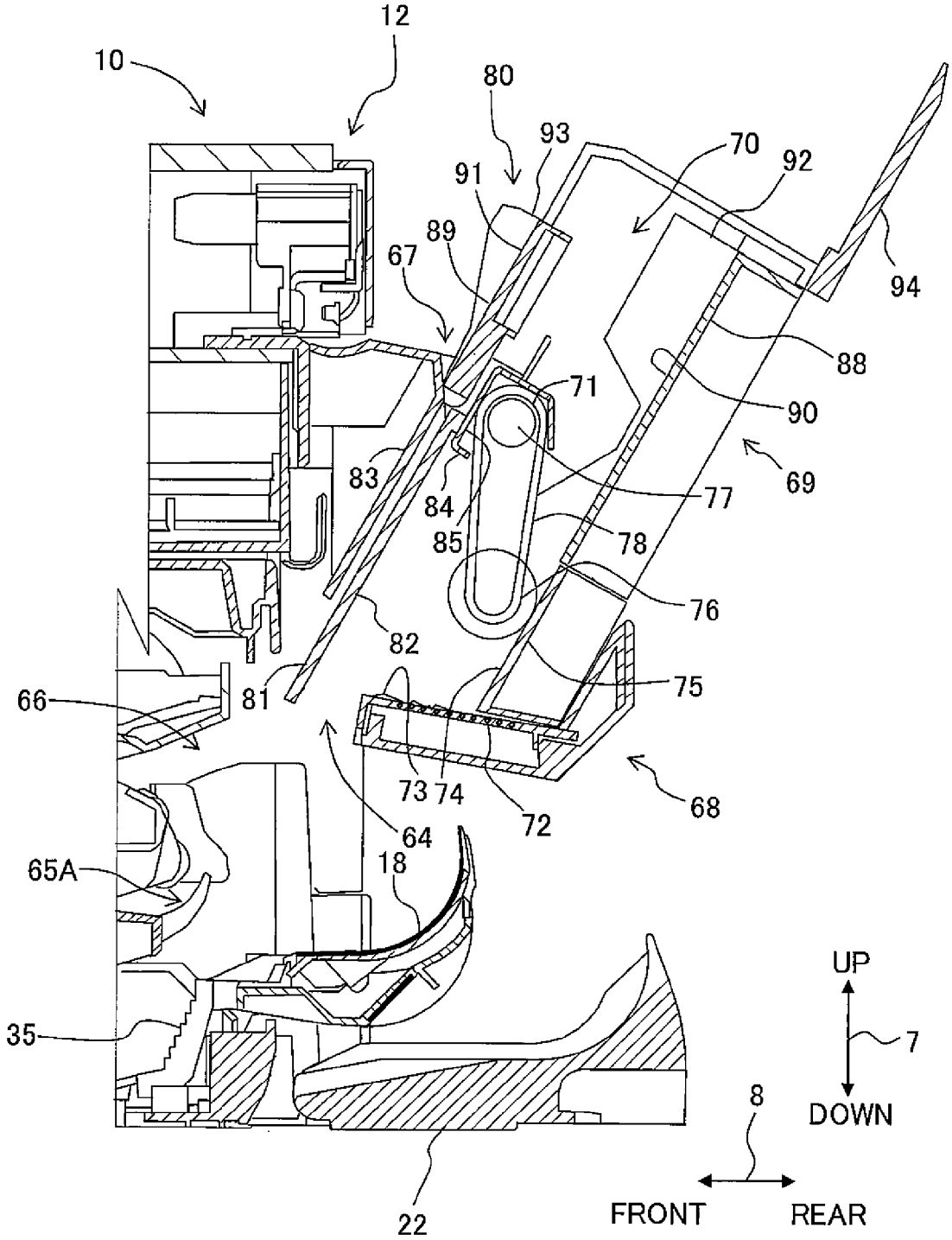
FIG. 8 shows an enlarged longitudinal sectional view illustrating the internal structure of the bypass tray and the manual feed tray in which the movable unit is in the inclined state and a back surface cover and an outer guide member are in the open state.

A back surface cover 22 is a member which supports the outer guide member 18 to constitute a part of the back surface of the casing 14. The back surface cover 22 is rotatably supported by the casing 14 at both left and right ends on the lower side. As shown in FIG. 8, as for the back surface cover 22, the upper side is fallen backwardly about the rotational shaft provided in the left-right direction 9 on the lower side, and thus the back surface cover 22 makes it possible to open or release the transport path 65 and the bypass route 66 described later on.

The outer guide member 18 is also rotatably supported by the casing 14 at both left and right ends on the lower side in the same manner as the back surface cover 22. As for the outer guide member 18, in a state in which the back surface cover 22 is open, the upper side is fallen backwardly about the rotational shaft provided in the left-right direction 9 on the lower side, and thus the curved passage 65A can be also opened or released. When the outer guide member 18 is opened, the curved passage 65A is opened thereby. As shown in FIG. 5, when the back surface cover 22 is allowed to upstand and the back surface cover 22 is closed, then the outer guide member 18 is supported by the back surface cover 22 from the backward, the outer guide member 18 is maintained in the upstanding state, and the outer guide member 18 is opposed to the inner guide member 19 to compart the curved passage 65A.

<First Transport Roller Pair 54 and Second Transport Roller Pair 55>

As shown in FIG. 5, the first transport roller pair 54 is provided on the upstream side in the transport direction (frontward orientation in the front-rear direction 8) from the recording unit 24 in the transport path 65. The first transport roller pair 54 has a first transport roller 60 and a pinch roller 61. The second transport roller pair 55 is provided on the downstream side in the transport direction from the recording unit 24 in the transport path 65. The second transport roller pair 55 has a second transport roller 62 and a spur 63. The first transport roller 60 and the second transport roller 62 are rotated by transmitting the rotation of a motor (not shown). The first transport roller pair 54 and the second transport roller pair 55 transport the recording paper sheet by rotating the first transport roller 60 and the second transport roller 62 in the state in which the recording paper sheet is interposed between the respective rollers for constructing the first transport roller pair 54 and the second transport roller pair 55. The first transport roller pair 54 and the second transport roller pair 55 correspond to the transport unit.

<Recording Unit 24>

As shown in FIG. 5, the recording unit 24 is provided on the upper side of the straight passage 65B while being opposed to the platen 42 between the first transport roller pair 54 and the second transport roller pair 55. The recording unit 24 is provided with a carriage 41 and a recording head 39. The carriage 41 is supported by guide rails 43, 44 provided on the back side and the front side of the platen 42. A known belt mechanism is provided for the guide rail 44. The carriage 41 is connected to an endless belt of the belt mechanism. The carriage 41 is movable in the left-right direction 9 along the guide rails 43, 44 in accordance with the rotation of the endless belt.

The recording head 39 is carried on the carriage 41. A plurality of nozzles (not shown) are formed on the lower surface of the recording head 39. Inks are supplied from ink cartridges (not shown) to the recording head 39. The recording head 39 selectively discharges the inks as minute ink droplets from the plurality of nozzles. When the carriage 41 is moved in the left-right direction 9, the ink droplets are discharged from the nozzles to the recording paper sheet supported by the platen 42. The discharged ink droplets adhere to the recording paper sheet on the platen 42, and thus an image is recorded on the recording paper sheet.

<Bypass Route 66>

An opening 64 is provided above the back surface cover 22 on the back surface of the casing 14. The bypass route 66, which extends from the opening 64 to the first transport roller pair 54, is formed at the inside of the casing 14. The bypass route 66 is the route which extends obliquely downwardly from the backward to the frontward in the front-rear direction 8. An upper guide surface of the bypass route 66 is formed by the guide member 31, and a lower guide surface is formed by the outer guide member 18 and the back surface cover 22. Both of the curved passage 65A and the straight passage 65B of the transport path 65 are arranged below the bypass route 66. As for the outer guide member 18 and the back surface cover 22, the upper side is rotated so that the upper side is fallen backwardly, and thus the bypass route 66 is opened or released together with the transport path 65.

The recording paper sheets, which are placed on a bypass tray 70 and a manual feed tray 80 described later on, are guided obliquely downwardly via the bypass route 66, and each of the recording paper sheets enters the straight passage 65B of the transport path 65. The image recording is performed by the recording unit 24 while transporting the recording paper sheet by the first transport roller pair 54, and the recording paper sheet is discharged to the discharge tray 21. In this way, the recording paper sheets, which are placed on the bypass tray 70 and the manual feed tray 80, are transported via the path having the substantially straight shape.

<Bypass Tray 70 and Manual Feed Tray 80>

The bypass tray 70 and the manual feed tray 80 are provided on the back surface side of the multifunction machine 10. The bypass tray 70 and the manual feed tray 80 support the recording paper sheet independently from the feed tray 20. The bypass tray 70 is arranged in an aligned manner in the up-down direction 7 on the back surface side of the multifunction machine 10 while allowing the manual feed tray 80 to be disposed thereover or thereabove. The bypass tray 70 corresponds to the first sheet support unit. The manual feed tray 80 corresponds to the second sheet support unit.

Figure 6:
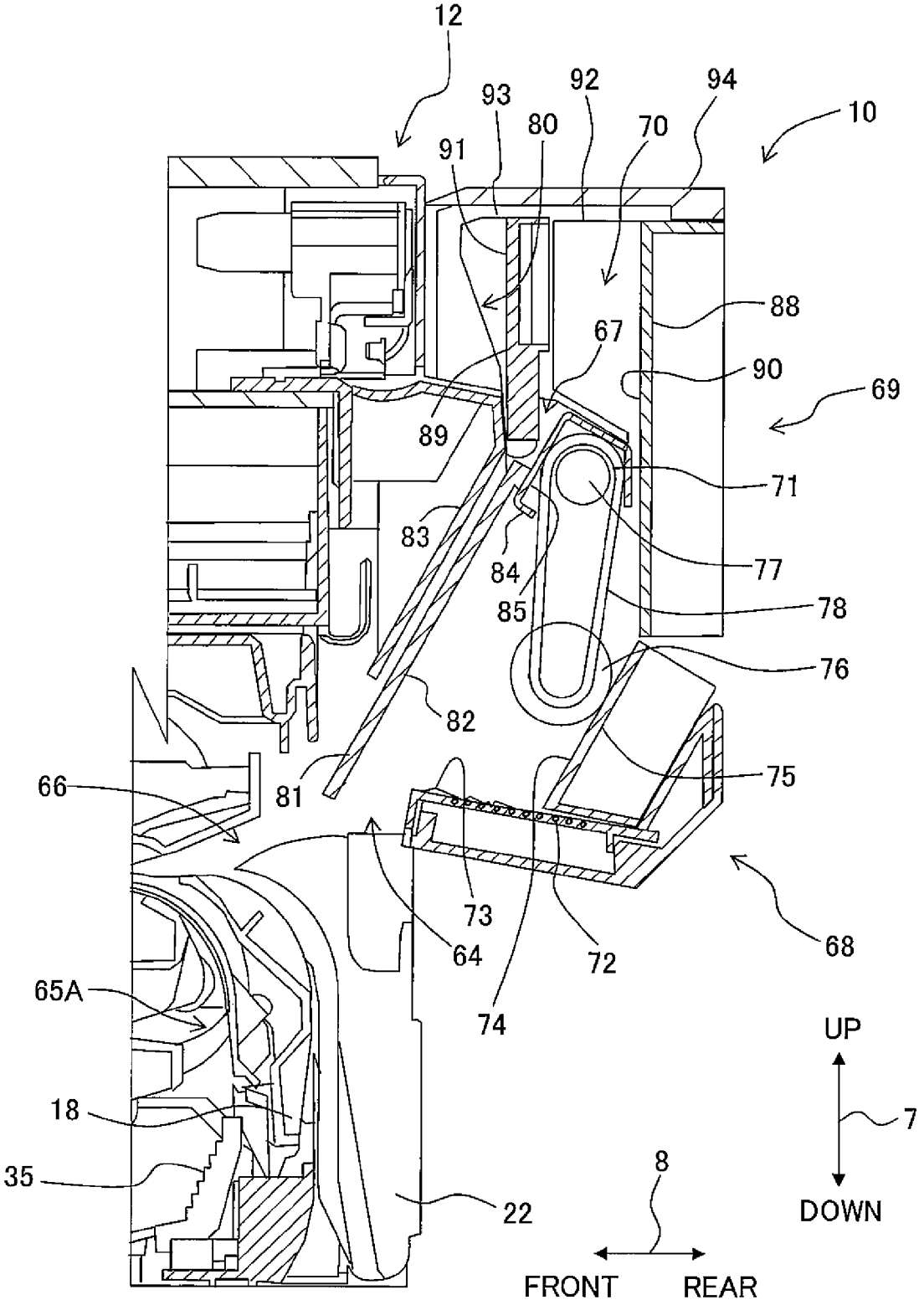
FIG. 6 shows an enlarged longitudinal sectional view illustrating the internal structure of a bypass tray and a manual feed tray in which the movable unit is in the upstanding state.

As shown in FIGS. 1 and 6, a fixed unit 68, which extends downwardly so that the opening 64 is covered therewith, is formed on the back surface side of the casing 16 of the scanner unit 12. The fixed unit 68 constitutes parts of the bypass tray 70 and the manual feed tray 80 on the downstream side in the transport direction. A movable unit 69 is provided rotatably on the upper side of the fixed unit 68. The bypass tray 70 and the manual feed tray 80 are constructed by the fixed unit 68 and the movable unit 69.

Figure 4:
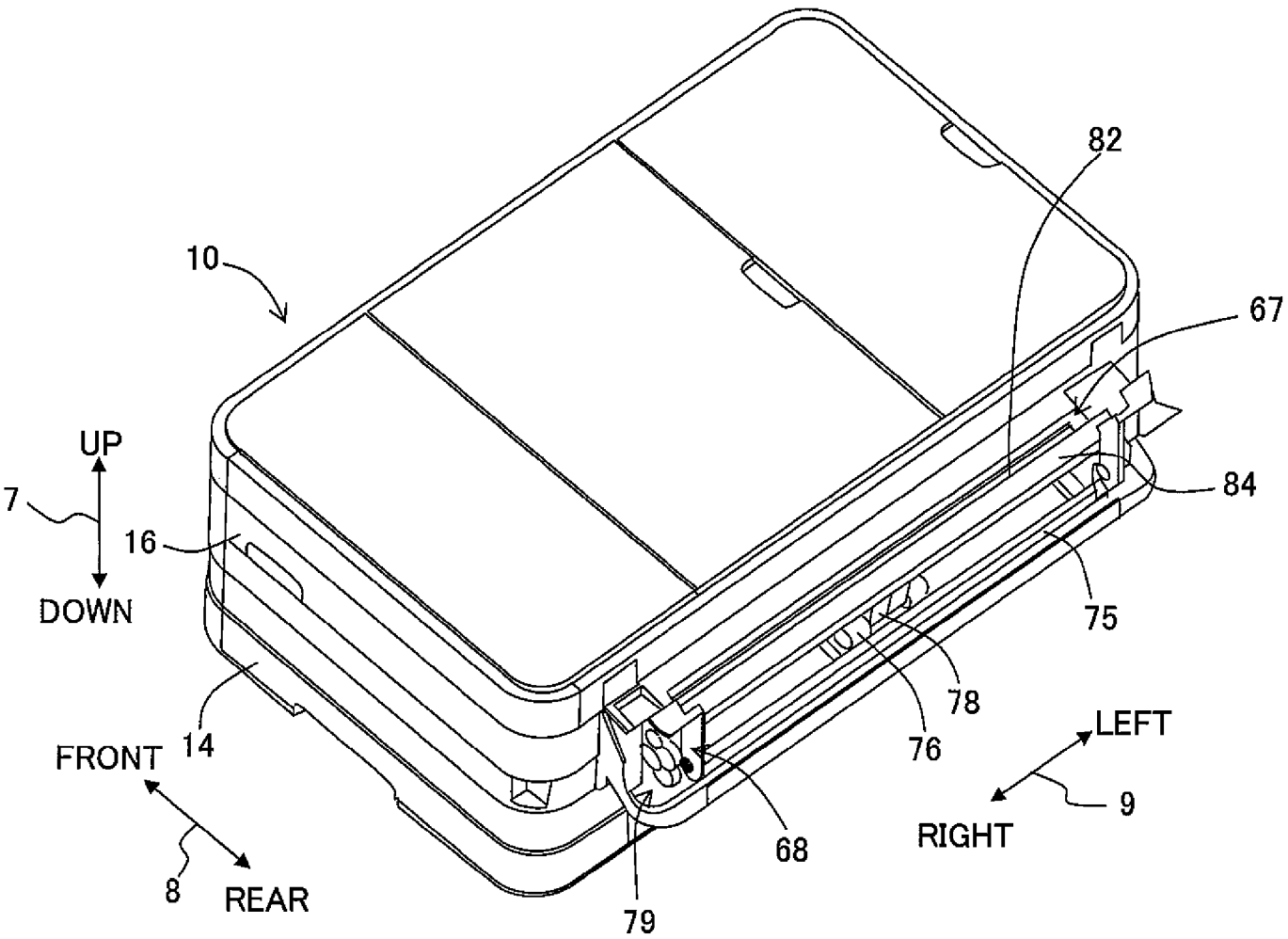
FIG. 4 shows a perspective view illustrating the multifunction machine on a back surface side in a state in which the movable unit is removed.
Figure 9:
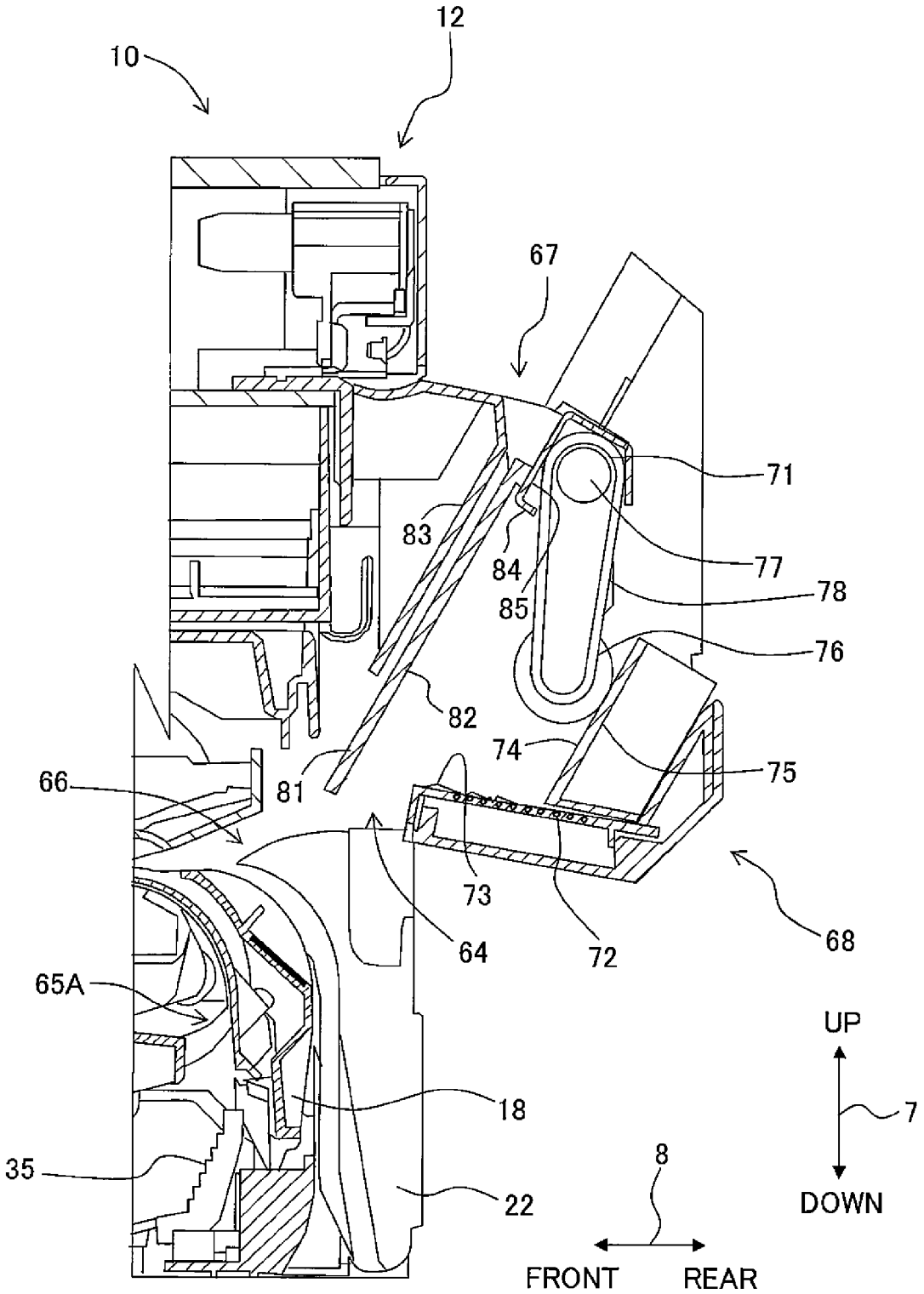
FIG. 9 shows an enlarged longitudinal sectional view illustrating the internal structure of the bypass tray and the manual feed tray in a state in which the movable unit is removed.

As shown in FIGS. 4 and 9, a slit-shaped opening 67, which extends in the left-right direction 9, is formed on the upper surface of the fixed unit 68. A passage is formed from the opening 67 toward the bypass route 66. A support member 82, which forms a support surface 81 of the manual feed tray 80, is provided on the lower side of the passage. The support surface 81 is inclined so that the lower end is directed more frontwardly with respect to the placement surface on which the multifunction machine 10 is placed. A guide member 83, which is opposed to the support surface 81, is provided on the upper side of the passage. The passage, which is comparted by the support member 82 and the guide member 83, extends obliquely downwardly from the opening 67, and the passage is connected to the bypass route 66. The lower end of the support member 82 forms a part of the guide surface on the upper side of the bypass route 66. The support surface 82 corresponds to the second support surface. The support member 82 corresponds to the second guide member. The placement surface, on which the multifunction machine 10 is placed in this embodiment, is the surface which expands in the left-right direction 9 and the front-rear direction 8.

A separation member 72 is provided below the support member 82 in the fixed unit 68. The separation member 72 is positioned at a height equivalent to that of the lower end circumferential edge of the opening 64 in the up-down direction 7. The separation member 72 extends obliquely downwardly from the lower end circumferential edge of the opening 64. The upper surface of the separation member 72 is the surface against which the forward end of the recording paper sheet supported by the bypass tray 70 abuts. A plurality of teeth 73 protrude upwardly from the upper surface while being aligned in the front-rear direction 8 on the upper surface of the separation member 72. The forward ends of the plurality of recording paper sheets supported by the bypass tray 70 are disentangled or unraveled by the teeth 73.

A support member 75, which is separated backwardly from the opening 64 and which forms a support surface 74 of the bypass tray 70, is provided above the separation member 72. The support surface 74 is inclined with respect to the placement surface on which the multifunction machine 10 is placed. The support surface 74 is substantially parallel to the support surface 81 of the manual feed tray 80. The support surface 74 corresponds to the first support surface.

A bearing unit 71, which rotatably supports a drive shaft 77 of a feed roller 76, is provided on the opposite side opposite to the support surface 81 on the upper end side of the support member 82. The drive shaft 77, which is supported by the bearing unit 71, is rotated by transmitting the driving force from an unillustrated motor via a driving transmitting unit 79 (see FIGS. 3 and 4).

Figure 3:
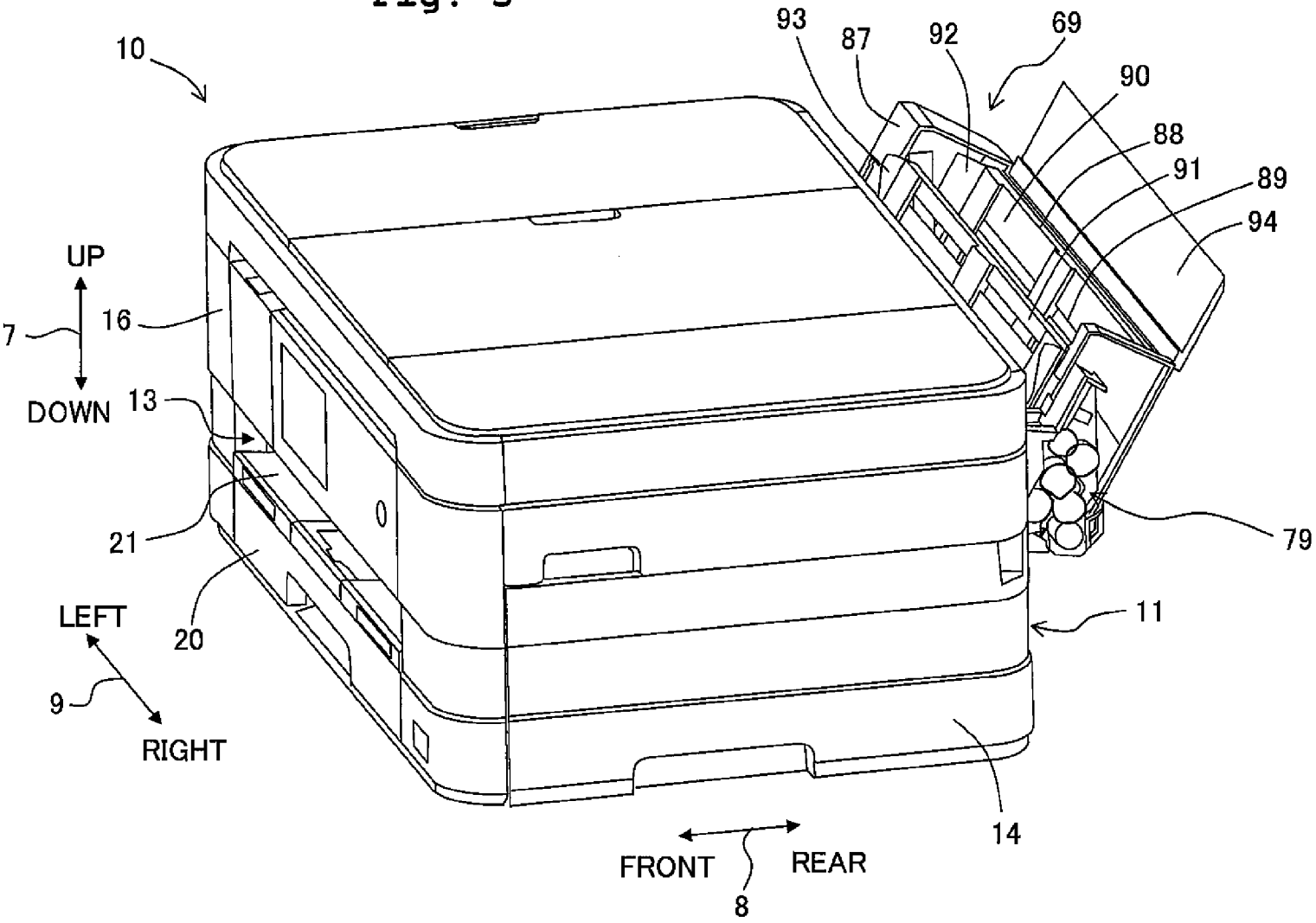
FIG. 3 shows a perspective view illustrating the multifunction machine in a state in which the movable unit is in the upstanding state and a side wall is removed.

As shown in FIGS. 3 and 4, the driving transmitting unit 79, which is composed of a plurality of pinion gears, is provided on the right side in the left-right direction 9 of the fixed unit 68. The driving force is transmitted to the driving transmitting unit 79 from the motor (not shown) provided at the inside of the casing 14 of the printer unit 11. The drive shaft 77 extends in the left-right direction 9, and one end thereof is meshed with the pinion gear which constitutes the driving transmitting unit 79. The other end of the drive shaft 77 extends to the center in the left-right direction 9 in the fixed unit 68.

An arm 78, which rotatably supports the feed roller 76, is provided on the other end side of the drive shaft 77. The arm 78 extends downwardly toward the support surface 74 of the support member 75 from the drive shaft 77. The arm 78 is arranged at the center in the left-right direction 9 in the fixed unit 68. The arm 78 is constructed to be rotatable about the drive shaft 77.

The feed roller 76 is provided on forward end side of the rotation of the arm 78. The feed roller 76 is connected to the drive shaft 77 by means of an unillustrated endless belt. The rotation of the drive shaft 77 is transmitted to the feed roller 76 by means of the endless belt, and the feed roller 76 is rotated. When the feed roller 76 is rotated in a state in which the feed roller 76 abuts against the recording paper sheet disposed on the uppermost side of the recording paper sheets supported by the support surface 74 of the bypass tray 70, the concerning recording paper sheet is thereby fed to the bypass route 66. The recording paper sheets, which are disposed on the lower side, are disentangled or unraveled by the teeth 73 of the separation member 72, and the recording paper sheets are retained in the bypass tray 70 without being dragged by the recording paper sheet disposed on the uppermost side. In this way, the feed unit, which is constructed by the feed roller 76, the drive shaft 77, and the arm 78, is arranged in the space which is comparted by the support surfaces 74, 81 at the outside of the casing 14.

A reinforcing member 84 is provided on a side opposite to the support surface 81 on the upper end side of the support member 82. A recess 85, which forms a step or difference in height with respect to the support surface 81, is provided on the upper end side of the support member 82. The reinforcing member 84 is provided in the recess 85. The reinforcing member 84 is the member which is obtained by folding and bending a metal plate, and the reinforcing member 84 is provided in order to reinforce the rigidity of the support member 82. The reinforcing member 84 extends in the left-right direction 9 of the support member 82 along the support surface 81, and the both ends thereof arrive at positions disposed in the vicinity of the both ends of the support member 82. The left-right direction 9, in which the reinforcing member 84 extends, is perpendicular to the transport direction of the recording paper sheet in relation to the manual feed tray 80.

Figure 2:
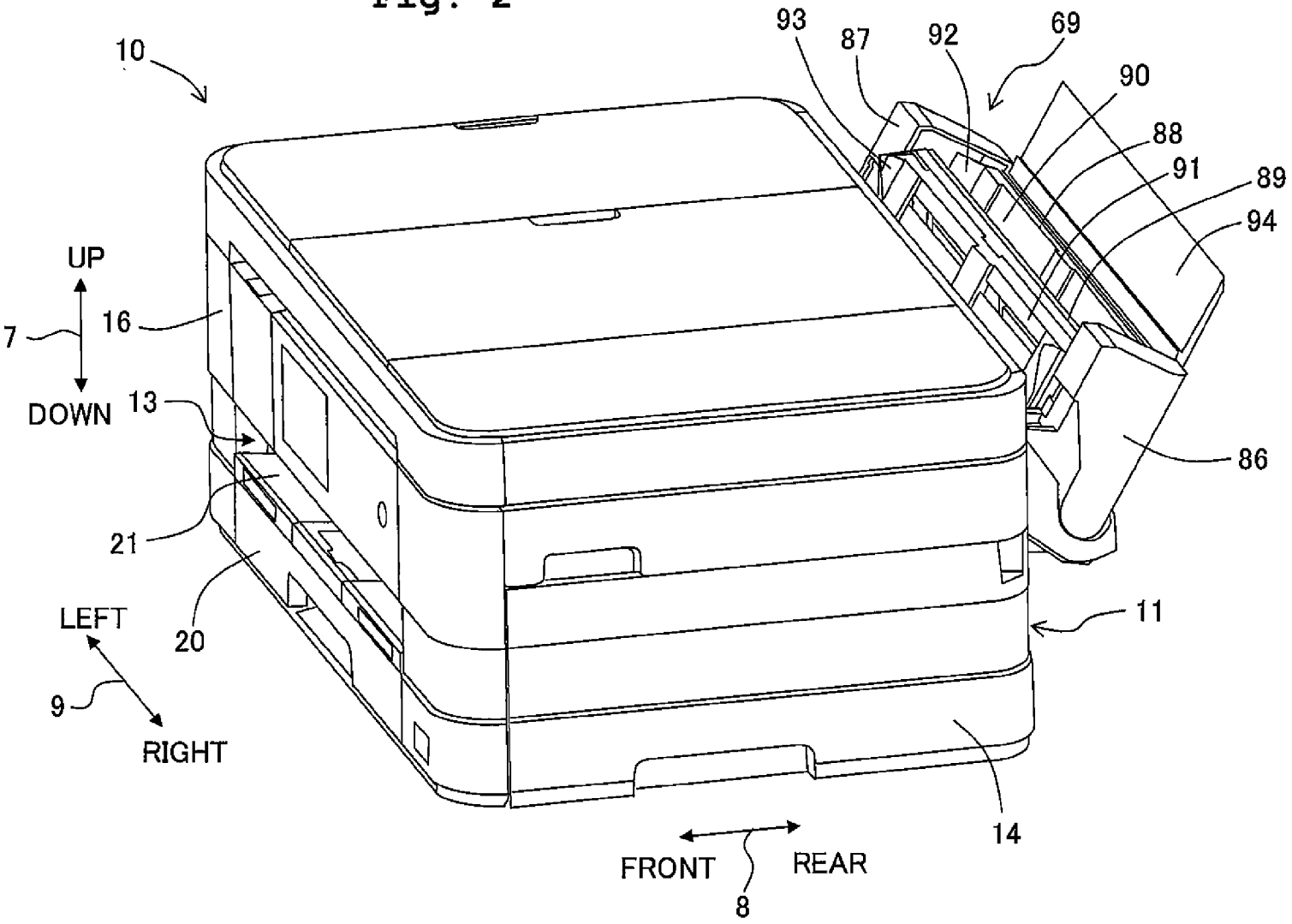
FIG. 2 shows a perspective view illustrating the multifunction machine in which the movable unit is in an inclined state.
Figure 7:
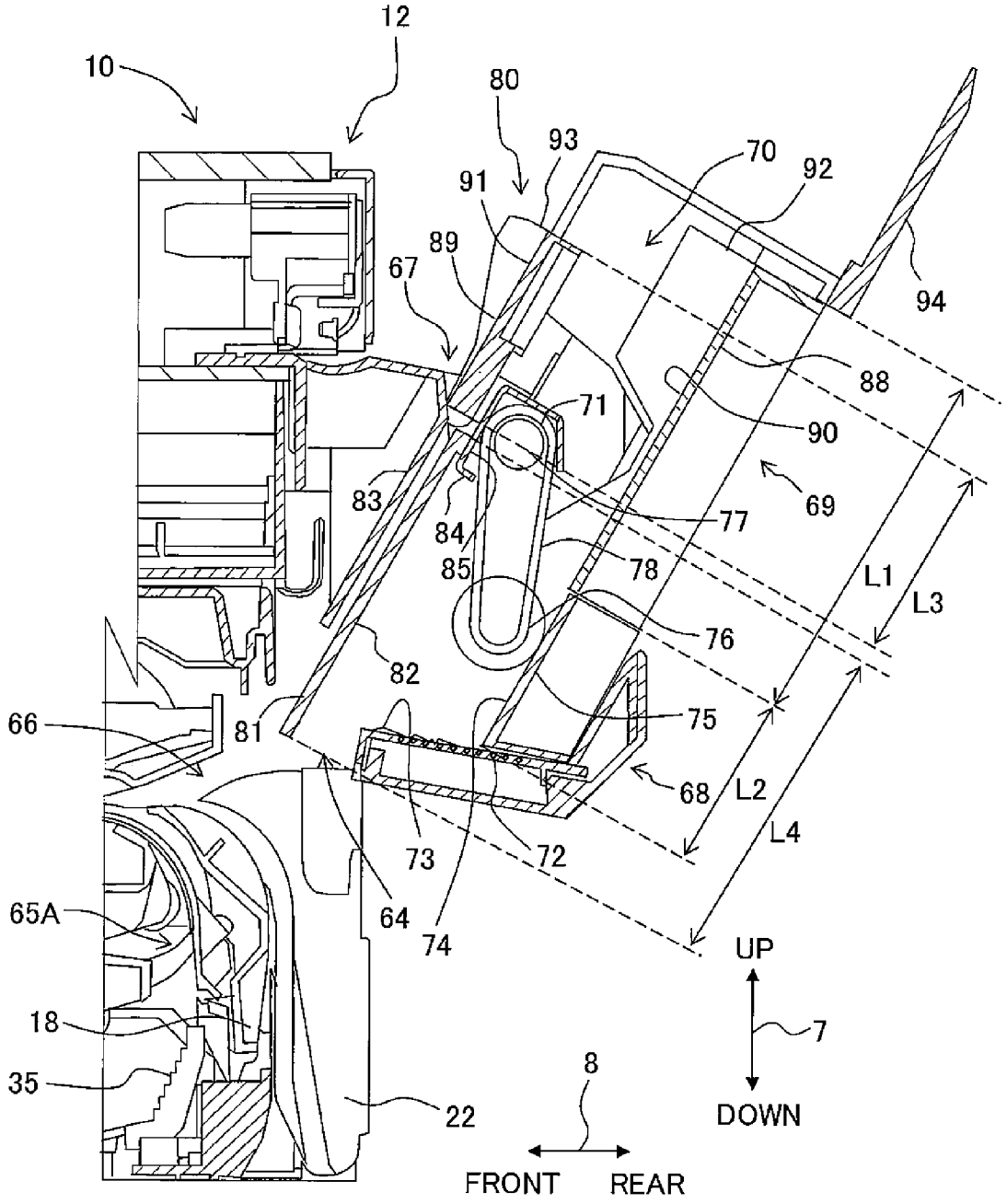
FIG. 7 shows an enlarged longitudinal sectional view illustrating the internal structure of the bypass tray and the manual feed tray in which the movable unit is in the inclined state.

As shown in FIGS. 2 and 7, the movable unit 69 is rotatably connected on the lower side of the fixed unit 68. The movable unit 69 is rotatable between the upstanding state in which the movable unit 69 upstands in the up-down direction 7 as shown in FIGS. 1 and 6 and the inclined state in which the movable unit 69 is inclined with respect to the up-down direction 7 as shown in FIGS. 2 and 7. The upstanding state is the state to be provided in order that the space for the movable unit 69 is decreased on the back surface side of the casing 14 when the bypass tray 70 and the manual feed tray 80 are not used. The movable unit 69, which is in the upstanding state, has the back surface which is substantially parallel to the back surface of the casing 14. The inclined state is the state in which the support surfaces 74, 81 are inclined respectively by inclining the movable unit 69 obliquely upwardly toward the outside of the casing 14, and the bypass tray 70 and the manual feed tray 80 can be used. Whether the movable unit 69 is allowed to be in the upstanding state or the inclined state can be arbitrarily selected in accordance with the operation of a user.

Side walls 86, 87 are provided on the both sides in the left-right direction 9 of the movable unit 69. The side walls 86, 87 cover parts of the both sides in the left-right direction 9 of the fixed unit 68. The driving transmitting unit 79, which is provided on the right side in the left-right direction 9 of the fixed unit 68, is covered with the side wall 86 of the movable unit 69.

A support member 88 and a support member 89 are provided to span the side walls 86, 87 of the movable unit 69. In the inclined state, a support surface 90, which is the upper surface of the support member 88, forms the flat surface which is flush with the support surface 74. In other words, the surface, which is formed by the support surface 74 and the support surface 90, supports the recording paper sheet in the bypass tray 70. Further, in the upstanding state, the support surface 90 is perpendicular to the placement surface for the multifunction machine 10, i.e., the support surface 90 extends in the up-down direction 7 and the left-right direction 9.

The length L1, which is provided in the transport direction of the support surface 90 of the movable unit 69, is longer than the length L2 which is provided in the transport direction of the support surface 74 of the fixed unit 68 (L1>L2). The length, which is obtained by totalizing the length L1 and the length L2, is set in conformity with the size of the recording paper sheet capable of being supported by the bypass tray 70.

In the inclined state, a surface which is formed by the support surface 81 and the support surface 91 supports the recording paper sheet in the manual feed tray 80. Further, in the upstanding state, the support surface 91 is perpendicular to the placement surface for the multifunction machine 10, i.e., the support surface 91 extends in the up-down direction 7 and the left-right direction 9.

The length L3, which is provided in the transport direction of the support surface 91 of the movable unit 69, is shorter than the length L4 which is provided in the transport direction of the support surface 81 of the fixed unit 68 (L3<L4). The length, which is obtained by totalizing the length L3 and the length L4, is set in conformity with the size of the recording paper sheet capable of being supported by the manual feed tray 80.

The support member 88 is provided with side guides 92. The side guides 92 are separated from each other in the left-right direction 9 to form a pair, and the side guides 92 protrude upwardly from the support surface 90. The side guide 92 has a guide surface which extends in the transport direction of the bypass tray 70, and the side guide 92 guides the end edge of the recording paper sheet supported by the support surface 90 in the transport direction by means of the guide surface. The distance, by which the pair of side guides 92 are separated from each other in the left-right direction 9, is variable. Accordingly, the side guides 92 can guide the end edges of the recording paper sheets having various sizes supported by the support surface 90.

The support member 89 is provided with side guides 93. The side guides 93 are separated from each other in the left-right direction 9 to form a pair, and the side guides 93 protrude upwardly from the support surface 91. The side guide 93 has a guide surface which extends in the transport direction of the manual feed tray 80, and the side guide 93 guides the end edge of the recording paper sheet supported by the support surface 91 in the transport direction by means of the guide surface. The distance, by which the pair of side guides 93 are separated from each other in the left-right direction 9, is variable. Accordingly, the side guides 93 can guide the end edges of the recording paper sheets having various sizes supported by the support surface 91.

A tray cover 94 is provided at the upper end of the support member 89. The tray cover 94 is provided rotatably with respect to the support member 89. The tray cover 94 is a flat plate-shaped member capable of sealing the openings of the bypass tray 70 and the manual feed tray 80 on the upper end sides. As shown in FIGS. 1 and 6, the tray cover 94 is rotatable to arrive at the position at which the openings on the upper end sides of the bypass tray 70 and the manual feed tray 80 are covered for the movable unit 69 in the upstanding state. Further, as shown in FIGS. 2 and 7, the tray cover 94 is rotatable to arrive at the position at which the openings on the upper end sides of the bypass tray 70 and the manual feed tray 80 are opened for the movable unit 69 in the inclined state. At this position, the tray cover 94 extends obliquely upwardly so that the support surface 90 of the bypass tray 70 is elongated, and it is possible to support the upper end side of the recording paper sheet protruding from the support surface 90.

<Operation of Printer Unit 11>

An explanation will be made below about the operation of the printer unit 11 as performed when the feed tray 20, the bypass tray 70, and the manual feed tray 80 are used respectively.

When the bypass tray 70 and the manual feed tray 80 are not used, the movable unit 69 is in the upstanding state as shown in FIGS. 1 and 6. Accordingly, the projected area of the movable unit 69 is decreased. Therefore, it is possible to decrease the space on the back surface side of the multifunction machine 10. Further, the tray cover 94 is rotated to the position at which the openings at the upper ends of the bypass tray 70 and the manual feed tray 80 are closed. If an enough space is provided on the back surface side of the multifunction machine 10, it is also allowable that the movable unit 69 is still in the inclined state even when the bypass tray 70 and the manual feed tray 80 are not used.

When the feed tray 20 is used, the recording paper sheet having a desired size is set to the feed tray 20. Specifically, a plurality of recording paper sheets are placed on the feed tray 20 in a state in which the plurality recording paper sheets are stacked. The feed tray 20, on which the recording paper sheets are placed, is allowed to be in a state of being inserted into the casing 14 through the opening 13. In this state, the feed roller 25 abuts against the uppermost recording paper sheet of the plurality of recording paper sheets placed on the feed tray 20. The printer unit 11 determines or decides the feeding of the recording paper sheet from the feed tray 20 on the basis of, for example, the input by the user and/or the printing data.

If the instruction to start the printing is accepted, the printer unit 11 drives the unillustrated motor to rotate the feed roller 25, the first transport roller pair 54, and the second transport roller pair 55 at predetermined timings. The uppermost recording paper sheet is fed from the paper feed tray 20 to the transport path 65 in response to the rotation of the feed roller 25. The recording paper sheet is guided by the curved passage 65A of the transport path 65, and the recording paper sheet arrives at the first transport roller pair 54. The ink droplets are discharged from the recording head 39 and a desired image is recorded on the recording paper sheet transported to the recording unit 24 by being interposed by the first transport roller pair 54. The recording paper sheet, for which the image recording has been completed, is discharged to the discharge tray 21 by means of the second transport roller pair 55.

When the bypass tray 70 and the manual feed tray 80 are used, the movable unit 69 is allowed to be in the inclined state as shown in FIGS. 2 and 7. Accordingly, the support surfaces 74, 90 form one flat surface in the bypass tray 70. The tray cover 94 is rotated to the position at which the openings on the upper end sides of the bypass tray 70 and the manual feed tray 80 are open.

When the bypass tray 70 is used, the recording paper sheet having a desired size is set to the bypass tray 70. Specifically, a plurality of recording paper sheets are placed on the support surfaces 74, 90 of the bypass tray 70 in a state in which the plurality of recording paper sheets are stacked. In this state, the feed roller 76 of the bypass tray 70 abuts against the uppermost recording paper sheet of the plurality of recording paper sheets supported by the support surfaces 74, 90. Further, the lower ends of the plurality of recording paper sheets abut against the separation member 72. The printer unit 11 determines or decides the feeding of the recording paper sheet from the bypass tray 70 on the basis of, for example, the input by the user and/or the printing data.

If the instruction to start the printing is accepted, the printer unit 11 drives the unillustrated motor to rotate the feed roller 76, the first transport roller pair 54, and the second transport roller pair 55 at predetermined timings. The uppermost recording paper sheet is fed from the bypass tray 70 to the bypass route 66 in response to the rotation of the feed roller 76. The recording paper sheet enters the straight passage 65B of the transport path 65 from the bypass route 66, and the recording paper sheet arrives at the first transport roller pair 54. During this process, the outer guide member 18, the back surface cover 22, and the guide member 31, which form the bypass route 66 and the straight passage 65B, guide the recording paper sheet toward the first transport roller pair 54. The ink droplets are discharged from the recording head 39 and a desired image is recorded on the recording paper sheet transported to the recording unit 24 by being interposed by the first transport roller pair 54. The recording paper sheet, for which the image recording has been completed, is discharged to the discharge tray 21 by means of the second transport roller pair 55.

When the manual feed tray 80 is used, the recording paper sheet having a desired size is set to the manual feed tray 80. Specifically, one recording paper sheet is placed on the support surfaces 81, 91 of the manual feed tray 80, and the recording paper sheet is inserted into the space between the first transport roller pair 54 and the feed roller 76 of the bypass tray 70 along the support surfaces 81, 91. Specifically, the recording paper sheet is inserted so that the forward end of the recording paper sheet enters the transport path 65 from the bypass route 66 until the forward end of the recording paper sheet abuts against the first transport roller pair 54. The support surfaces 81, 91 of the manual feed tray 80 support the recording paper sheet at the lower positions in a state in which the recording paper sheet is inserted until the forward end of the recording paper sheet abuts against the first transport roller pair 54. The printer unit 11 judges the feeding of the recording paper sheet from the manual feed tray 80 on the basis of, for example, the input by the user and/or the printing data. The printer unit 11 may determine or decide the feeding of the recording paper sheet from the manual feed tray 80 on the basis of the fact that a sensor 56, which is arranged on the upstream side in the transport direction of the first transport roller pair 54, detects the recording paper sheet set in the manual feed tray 80.

If the instruction to start the printing is accepted, the printer unit 11 drives the unillustrated motor to rotate the first transport roller pair 54 and the second transport roller pair 55 at predetermined timings. The recording paper sheet, which is set to the manual feed tray 80, is interposed by the first transport roller pair 54 in accordance with the rotation of the first transport roller 60. The ink droplets are discharged from the recording head 39 and a desired image is recorded on the recording paper sheet transported to the recording unit 24. The recording paper sheet, for which the image recording has been completed, is discharged to the discharge tray 21 by means of the second transport roller pair 55.

<Effect of Embodiment>

According to this embodiment, the bypass tray 70 and the manual feed tray 80 are arranged on the back surface side of the casing 14, and the support surfaces 74, 90 and the support surfaces 81, 91 are allowed to be in the state in which they are inclined with respect to the placement surface of the multifunction machine 10. Therefore, the maximum size (dimension) of the multifunction machine 10 is decreased, and the installation area of the multifunction machine 10 is decreased. Accordingly, the small-sized multifunction machine 10 is realized, in which the recording paper sheets can be supported at a plurality of independent positions.

The manual feed tray 80 guides the recording paper sheet to the space between the feed roller 76 and the first transport roller pair 54. Therefore, the bypass tray 70 in which the recording paper sheet is fed by the feed roller 76 and the manual feed tray 80 in which the recording paper sheet can be directly guided to the transport path 65 are realized.

The recording paper sheet of high frequency of use is supported by the bypass tray 70, and the manual feed tray 80, which supports the recording paper sheet to be temporarily used, is arranged above the bypass tray 70. Therefore, the user can easily access the manual feed tray 80.

The feed roller 76, the drive shaft 77, and the arm 78 are positioned in the space comparted by the support surfaces 74, 90 and the support surfaces 81, 91 at the outside of the casing 14. Therefore, the multifunction machine 10 is small-sized.

The transport path 65 has the curved passage 65A in which the transport direction of the recording paper sheet is inverted from the backward orientation (direction) to the frontward orientation (direction) and the straight passage 65B in which the transport direction of the recording paper sheet is not inverted. The bypass tray 70 and the manual feed tray 80 guide the recording paper sheet to the straight passage 65B without inverting the transport direction of the supporting recording paper sheet. Therefore, the U-turn pass and the straight pass are realized.

The recording paper sheet, which is supplied to the transport path 65 for inverting the transport direction of the recording paper sheet, is supported by the feed tray 20.

The bypass tray 70 and the manual feed tray 80 are arranged on the back surface of the casing 14, and the feed tray 20 is movable back and forth with respect to the casing 14 via the opening 13 disposed on the front surface of the casing 14. Therefore, the small-sized multifunction machine 10 is realized while suppressing the height of the casing 14 to be low.

The bypass route 66 is comparted by the outer guide member 18 which is arranged at the downward position as compared with the support surfaces 74, 81, 90, 91. Therefore, the recording paper sheets, which are fed from the bypass tray 70 and the manual feed tray 80, are smoothly guided by the outer guide member 18.

The outer guide member 18 and the back surface cover 22 are subjected to the state change to provide the state in which the curved passage 65A is open to the outside. Therefore, the recording paper sheet, which causes the jamming or clog-up in the bypass route 66 and the curved passage 65A, can be easily removed or eliminated.

The outer guide member 18 guides the recording paper sheet obliquely downwardly toward the first transport roller pair in the bypass route 66. Therefore, the recording paper sheet is smoothly guided to the first transport roller pair 54 by means of the outer guide member 18.

The lower end of the support member 82 comparts the part of the bypass route 66. Therefore, the recording paper sheet, which is flexibly bent or warped in the orientation (upward orientation) to make separation from the outer guide member 18 in the bypass route 66, can be held or supported by the support member 82.

The bypass tray 70 and the manual feed tray 80 are constructed by the fixed unit 68 which is provided for the casing 14 and the movable unit 69 which is rotatably provided for the fixed unit 68. Therefore, the smaller-sized multifunction machine 10 is realized owing to the rotation of the movable unit 69.

The length L1, which is provided in the transport direction of the support surface 90 provided for the movable unit 69, is longer than the length L2 which is provided in the transport direction of the support surface 74 provided for the fixed unit 68. The support surface 90 is subjected to the state change to provide the state in which the support surface 90 is perpendicular to the placement surface of the multifunction machine 10. Therefore, the multifunction machine 10 is efficiently small-sized.

The length L4, which is provided in the transport direction of the support surface 81 provided for the fixed unit 68, is longer than the length L3 which is provided in the transport direction of the support surface 91 provided for the movable unit 69. Therefore, the accuracy is raised for the angles by which the support surfaces 81, 91 are inclined with respect to the bypass route 66.

One recording paper sheet is separated by the feed roller 76 and the separation member 72 from the bundle of the plurality of recording paper sheets supported by the bypass tray 70, and one recording paper sheet is fed to the bypass route 66.

The separation member 72 is provided for the fixed unit 68. Therefore, the accuracy is raised for the position at which the recording paper sheet enters the bypass route 66 from the separation member 72. Further, the accuracy is raised for the angle by which the separation member 72 is inclined with respect to the bypass route 66.

The fixed unit 68 is provided with the driving transmitting unit 79 and the feed roller 76. Therefore, the driving force transmission, which is effected from the motor provided at the inside of the casing 14 to the feed roller 76, is stabilized.

The support member 82 of the manual feed tray 80 has the bearing unit 71 which rotatably supports the drive shaft 77 of the feed roller 76. Therefore, it is unnecessary to distinctly provide any member for the bearing of the feed roller 76, and the multifunction machine 10 is small-sized.

The support member 82 of the manual feed tray 80 has the reinforcing member 84 which reinforces the bearing unit 71. Therefore, even when the support member 82 of the manual feed tray 80 is provided as a molded product of synthetic resin, the support member 82 is prevented from being flexibly bent or warped by the reaction force generated when the feed roller 76 feeds the recording paper sheet.

The reinforcing member 84 extends in the left-right direction 9 which extends along the support surface 81 and which is perpendicular to the transport direction of the recording paper sheet in the manual feed tray 80. Therefore, the support member 82 is prevented from being flexibly bent or warped in the left-right direction 9.

The feed roller 76 is rotatably supported by the arm 78 which is rotatably provided on the drive shaft 77. Therefore, when the recording paper sheet is fed, the feed roller 76 is brought in contact with the sheet under pressure in accordance with the rotation of the arm 78. When the recording paper sheet is transported by the first transport roller pair 54, the load on the recording paper sheet exerted by the feed roller 76 is mitigated in accordance with the rotation of the arm 78.

The movable unit 69 has the side guides 92 which guide the end edges in the transport direction of the recording paper sheet supported by the support surfaces 74, 90. Therefore, when the bypass tray 70 is supplemented with the recording paper sheet, it is easy to perform the positional adjustment.

The tray cover 94 is provided, which covers those disposed over or above the support surfaces 74, 90 of the bypass tray 70 and the support surfaces 81, 91 of the manual feed tray 80. Therefore, any dust is prevented from entering the interior of the casing 14 via the opening 64 of the casing 14 from the bypass tray 70 and the manual feed tray 80 when the movable unit 69 is in the upstanding state.

What is claimed is:

1. An image recording apparatus comprising:

an apparatus casing in which a transport path is formed, wherein the transport path comprises a straight passage;

a first sheet support unit including a first support surface and a third support surface;

a feed unit configured to feed a sheet supported by the first support surface and the third support surface to the transport path;

a second sheet support unit including a second support surface and a fourth support surface;

a transport unit configured to transport a sheet via the transport path, the sheet being either the sheet supported by the first support surface and the third support surface or a sheet supported by the second support surface and the fourth support surface;

a recording unit which is positioned in the straight passage and configured to record an image on the sheet which is transported by the transport unit in the transport path;

a fixed unit including the first support surface and the second support surface, wherein the fixed unit is fixed to the apparatus casing, and the first support surface and the second support surface are inclined with respect to a placement surface on which the apparatus casing is placed; and a movable unit including the third support surface and the fourth support surface, wherein the first sheet support unit and the second sheet support unit are arranged on one side surface of the apparatus casing, a position of the first support surface relative to a position of the second support surface remains unchanged, and wherein the movable unit is configured to be movable between an inclined state in which the third support surface and the fourth support surface are inclined to be parallel to the first support surface and the second support surface respectively, and an upstanding state in which the third support surface and the fourth support surface upstand to intersect the first support surface and the second support surface respectively.

2. The image recording apparatus according to claim 1, wherein a length in the transport direction of the first support surface is shorter than a length in the transport direction of the third support surface.

3. The image recording apparatus according to claim 2, wherein a length in the transport direction of the second support surface is longer than a length in the transport direction of the fourth support surface.

4. The image recording apparatus according to claim 2, wherein the feed unit is positioned in a space which is disposed outside the apparatus casing and which is comparted by the first support surface and the second support surface.

5. The image recording apparatus according to claim 1, wherein the movable unit is configured to be movable with respect to the fixed unit.

6. The image recording apparatus according to claim 1, wherein the movable unit has a side guide configured to guide an end edge extending in the transport direction of the sheet which is supported by the first support surface and the third support surface.

7. The image recording apparatus according to claim 1, wherein the movable unit has a side guide configured to guide an end edge extending in the transport direction of the sheet which is supported by the second support surface and the fourth support surface.

8. The image recording apparatus according to claim 1, wherein the transport unit has a transport roller pair, and the second sheet support unit is configured to guide the sheet supported by the second support surface and the fourth support surface to a space between the transport roller pair and the feed unit in the transport path.

9. The image recording apparatus according to claim 1, wherein the second sheet support unit is positioned above the first sheet support unit.

* * * * *